US005946952A

United States Patent [19]

Mintchenko

[11] Patent Number: 5,946,952

[45] Date of Patent: Sep. 7, 1999

[54] LOCK COVER SYSTEM

[76] Inventor: Jouri Mintchenko, 69-54 230th St., Bayside, N.Y. 11364

[21] Appl. No.: 09/199,268

[22] Filed: Nov. 25, 1998

[51] Int. Cl.[6] ..... E05B 65/48

[52] U.S. Cl. ..... 70/2; 70/6; 70/32; 70/34; 70/56; 70/129; 292/148; 292/150; 292/283

[58] Field of Search ..... 70/2–13, 54–56, 70/31–34, 129, DIG. 56; 292/148, 150, 281, 283–286

[56] References Cited

U.S. PATENT DOCUMENTS

| | | | |
|---|---|---|---|
| 168,566 | 10/1875 | Hilton | 70/DIG. 56 X |
| 3,744,280 | 7/1973 | Brown, Jr. et al. | 70/54 |
| 3,820,360 | 6/1974 | Best | 70/32 X |
| 3,996,774 | 12/1976 | Best | 70/34 X |
| 4,031,719 | 6/1977 | Klingler et al. | 70/56 |
| 4,068,505 | 1/1978 | Volk, Jr. | 70/56 |
| 4,372,138 | 2/1983 | De Forrest | 70/56 |
| 4,655,487 | 4/1987 | Korn et al. | 70/56 X |
| 4,911,486 | 3/1990 | Anderson | 70/54 X |
| 4,938,041 | 7/1990 | O'Gara | 70/33 X |
| 4,977,763 | 12/1990 | Sewell | 70/54 |
| 5,307,653 | 5/1994 | Davis | 70/56 |
| 5,477,710 | 12/1995 | Stefanutti | 70/54 X |

*Primary Examiner*—Lloyd A. Gall

[57] ABSTRACT

A door locking assembly is provided including a base having a pair of halves. A first one of the halves is adapted for being mounted to a door and a second one of the halves for being mounted on a door frame. The halves each include a slot formed therein. A sliding bar is included having a first orientation in engagement with both slots of the base for precluding the door from being opened and a second orientation with only one of the slots of the base receiving the sliding bar for allowing the door to be opened. Next provided is a cover removably mounted over the sliding bar for precluding the same from being removed from the first orientation. For precluding the removal of the cover, a locking mechanism is included which is adapted to engage both the cover and the sliding bar.

6 Claims, 2 Drawing Sheets

LOCK COVER SYSTEM

BACKGROUND OF THE INVENTION

1. Field of the Invention

The present invention relates to pad lock assemblies and more particularly pertains to a new lock cover system for providing a lock which is not easily penetrated.

2. Description of the Prior Art

The use of pad lock assemblies is known in the prior art. More specifically, pad lock assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art pad lock assemblies include U.S. Pat. No. 5,275,028; U.S. Pat. No. 5,244,101; U.S. Pat. No. 4,033,156; U.S. Pat. No. 4,843,845; U.S. Pat. No. 4,866,960; and U.S. Des. Patent No. 243,150.

In these respects, the lock cover system according to the present invention substantially departs from the conventional concepts and designs of the prior art, and in so doing provides an apparatus primarily developed for the purpose of providing a lock which is not easily penetrated.

SUMMARY OF THE INVENTION

In view of the foregoing disadvantages inherent in the known types of pad lock assemblies now present in the prior art, the present invention provides a new lock cover system construction wherein the same can be utilized for providing a lock which is not easily penetrated.

The general purpose of the present invention, which will be described subsequently in greater detail, is to provide a new lock cover system apparatus and method which has many of the advantages of the pad lock assemblies mentioned heretofore and many novel features that result in a new lock cover system which is not anticipated, rendered obvious, suggested, or even implied by any of the prior art pad lock assemblies, either alone or in any combination thereof.

To attain this, the present invention generally comprises a base having a pair of halves each including a semicircular rear plate. As shown in FIG. 1, the rear plate is equipped with a front face, a rear face and a periphery formed therebetween defined by a linear edge and a semicircular edge. In use, a first one of the halves is mounted to a door while a second one of the halves is mounted on a door frame. As such, the linear edges of the halves reside continuous with an edge of the door and the frame, respectively. Each half of the base has a pair of vertically spaced countersunk bores formed in the front face thereto. Further, a dovetail recess is formed between the linear edge and a central extent of the rear plate. A peripheral side wall is integrally coupled to the semicircular edge and extends therefrom in perpendicular relationship therewith. For reasons that will soon become apparent, the peripheral side wall of each half has a slot formed therein which extends along a central 30 degree arc of the peripheral side wall. As shown in FIG. 1, the slot is formed in parallel with the rear plate and an outer edge of the peripheral side wall. Formed in the outer edge of the peripheral side wall at a lower end thereof is a cut out. Next provided is a sliding bar having a generally planar rectangular configuration including a front face, a rear face and a periphery formed therebetween. As shown in FIGS. 1, 2, & 3, the sliding bar is equipped with a linear top edge, a linear bottom edge and a pair of tapering side edges. The front face of the sliding bar has a disk-shaped tongue integrally coupled to a central extent thereof with a bore formed therein. The bore of the disk-shaped tongue is formed about an axis parallel with a plane in which the sliding bar resides and further bisects the sliding bar. The rear face of the sliding bar has a dovetail tenon formed in a central extent thereof with a width about ⅓ that of the tongue. In operation, the dovetail tenon is slidably received within the dovetail recesses of the back plate. As such, the sliding bar has a first orientation with the side edges thereof in engagement with both slots of the base. In the first orientation, the sliding bar is adapted for precluding the door from being opened. In a second and third laterally offset orientation, only one of the slots of the base receives the sliding bar for allowing the door to be opened. Also included is a solid cover having a planar circular front face, a rear face with a planar semicircular lower extent and an inset planar semicircular upper extent, and a periphery formed therebetween. FIGS. 5 & 6 shows the solid cover to have a rectangular recess formed in the upper extent of the rear face. Ideally, a width of the recess of the solid cover is equal to that of the tongue of the sliding bar. FIGS. 7 & 8 show a conduit formed in the periphery of the solid cover and extending through and in perpendicular relationship with the rectangular recess. The rear face of the solid cover may be removably positioned between the side walls of the base such that the tongue of the sliding bar resides within the recess in the first orientation. The recess of the solid cover ensures that the bore of the sliding bar remains in alignment with the conduit of the solid cover. Finally, a locking plunger is slidably positioned within the conduit of the solid cover. As shown in the Figures, the locking plunger has an outboard end with a key hole formed therein. In use, the locking plunger has a first orientation with an inboard end out of engagement with the tongue of the sliding bar and the outboard end extending from solid cover through the cutouts of the base. In a second orientation, the inboard end of the locking plunger is inserted within the bore of the tongue of the sliding bar for maintaining the same within the first orientation to preclude opening of the door.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lock cover system apparatus and method which has many of the advantages of the pad lock assemblies mentioned heretofore and many novel features that result in a new lock cover system which is not anticipated, rendered obvious, suggested, or even implied by any of the prior art pad lock assemblies, either alone or in any combination thereof.

It is another object of the present invention to provide a new lock cover system which may be easily and efficiently manufactured and marketed.

It is a further object of the present invention to provide a new lock cover system which is of a durable and reliable construction.

An even further object of the present invention is to provide a new lock cover system which is susceptible of a low cost of manufacture with regard to both materials and labor, and which accordingly is then susceptible of low prices of sale to the consuming public, thereby making such lock cover system economically available to the buying public.

Still yet another object of the present invention is to provide a new lock cover system which provides in the apparatuses and methods of the prior art some of the advantages thereof, while simultaneously overcoming some of the disadvantages normally associated therewith.

Still another object of the present invention is to provide a new lock cover system for providing a lock which is not easily penetrated.

Even still another object of the present invention is to provide a new lock cover system that includes a base having a pair of halves. A first one of the halves is adapted for being mounted to a door and a second one of the halves for being mounted on a door frame. The halves each include a slot formed therein. A sliding bar is included having a first orientation in engagement with both slots of the base for precluding the door from being opened and a second orientation with only one of the slots of the base receiving the sliding bar for allowing the door to be opened. Next provided is a cover removably mounted over the sliding bar for precluding the same from being removed from the first orientation. For precluding the removal of the cover, a locking mechanism is included which is adapted to engage both the cover and the sliding bar.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
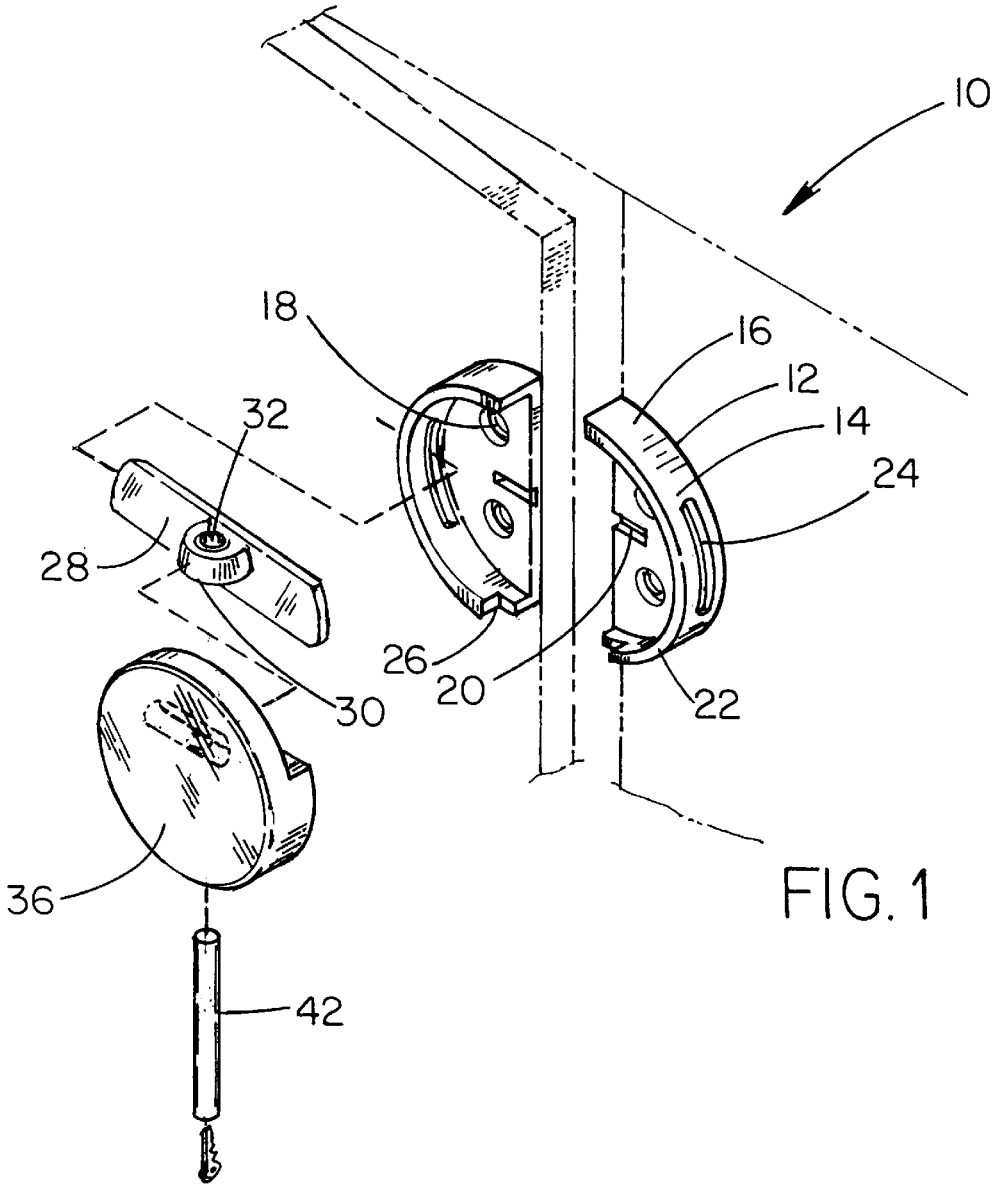
FIG. 1 is an exploded perspective view of a new lock cover system according to the present invention.

With reference now to the drawings, and in particular to FIGS. 1 through 8 thereof, a new lock cover system embodying the principles and concepts of the present invention and generally designated by the reference numeral 10 will be described.

The present invention, designated as numeral 10, includes a base 12 having a pair of halves 14 each including a semicircular rear plate 16. As shown in FIG. 1, the rear plate is equipped with a front face, a rear face and a periphery formed therebetween defined by a linear edge and a semicircular edge. In use, a first one of the halves is mounted to a door while a second one of the halves is mounted on a door frame. As such, the linear edges of the halves reside continuous with an edge of the door and the frame, respectively.

Figure 4:
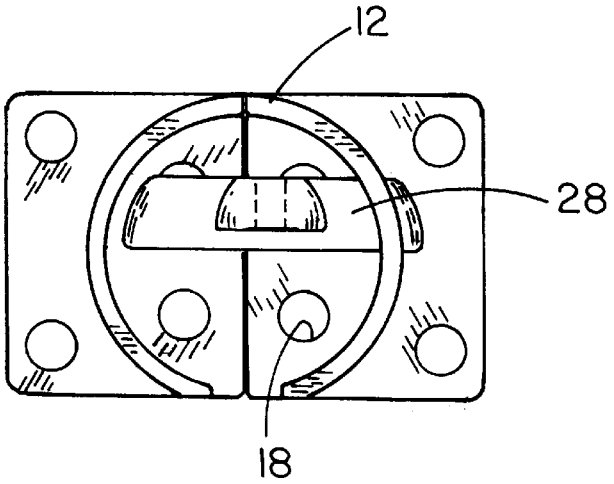
FIG. 4 is a front view of the sliding bar and base of the present invention.
Figure 7:
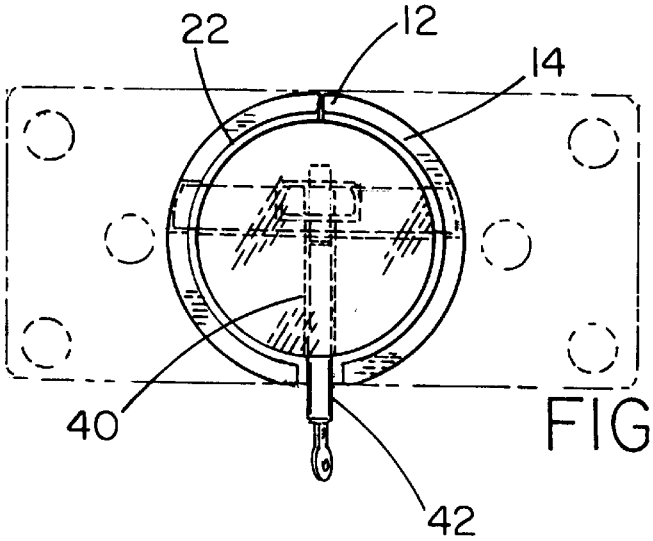
FIG. 7 is a front view of the present invention during use.

Each half of the base has a pair of vertically spaced countersunk bores 18 formed in the front face thereof for mounting purposes. As an option, as shown in FIGS. 4 & 7, the rear plate may be rectangular in form instead of semicircular. As such, further mounting bores may be formed in the rear plate. Also, a dovetail recess 20 is formed between the linear edge and a central extent of the rear plate. A peripheral side wall 22 is integrally coupled to the semicircular edge and extends therefrom in perpendicular relationship therewith. For reasons that will soon become apparent, the peripheral side wall of each half has a slot 24 formed therein which extends along a central 30 degree arc of the peripheral side wall. As shown in FIG. 1, the slot is formed in parallel with the rear plate and an outer edge of the peripheral side wall. Formed in the outer edge of the peripheral side wall at a lower end thereof is a cut out 26.

Figure 2:
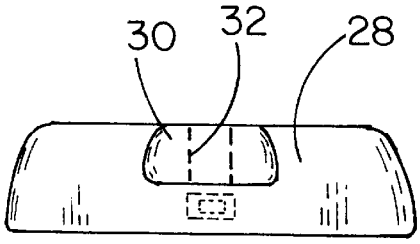
FIG. 2 is a front view of the sliding bar of the present invention.
Figure 3:
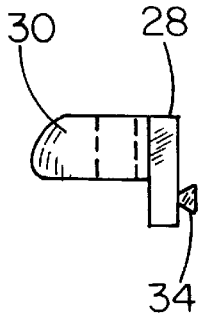
FIG. 3 is a side view of the sliding bar of the present invention.

Next provided is a sliding bar 28 having a generally planar rectangular configuration including a front face, a rear face and a periphery formed therebetween. As shown in FIGS. 1, 2, & 3, the sliding bar is equipped with a linear top edge, a linear bottom edge and a pair of tapering side edges. The front face of the sliding bar has a disk-shaped tongue 30 integrally coupled to a central extent thereof with a bore 32 formed therein. Ideally, the disk-shaped tongue has a slightly tapered side wall to define a slightly frustoconical configuration. The bore of the disk-shaped tongue is formed about an axis parallel with a plane in which the sliding bar resides and further bisects the sliding bar. The rear face of the sliding bar has a dovetail tenon 34 formed in a central extent thereof with a width about ⅓ that of the tongue which is in turn ⅓ a length of the sliding bar.

In operation, the dovetail tenon is slidably received within the dovetail recesses of the back plate. As such, the sliding bar has a first orientation with the side edges thereof in engagement with both slots of the base. In the first orientation, the sliding bar is adapted for precluding the door from being opened. In a second and third laterally offset orientation, only one of the slots of the base receives the sliding bar for allowing the door to be opened.

Figure 8:
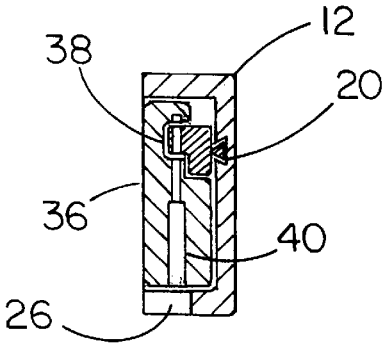
FIG. 8 is a cross-sectional view of the present invention.
Figure 5:
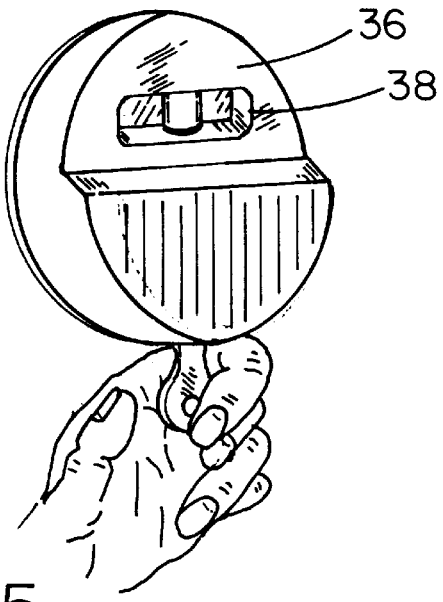
FIG. 5 is a rear perspective view of the locking plunger and cover of the present invention.
Figure 6:
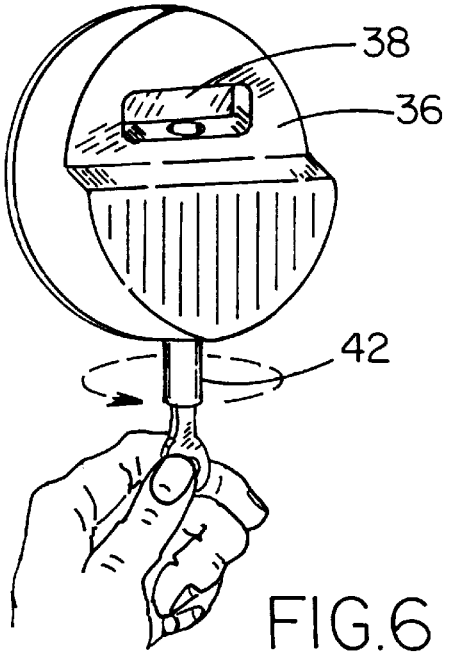
FIG. 6 is another rear perspective view of the locking plunger and cover of the present invention.

Also included is a solid cover 36 having a planar circular front face, a rear face with a planar semicircular lower extent and an inset planar semicircular upper extent, and a periphery formed therebetween. FIGS. 5 & 6 shows the solid cover to have a rectangular recess 38 formed in the upper extent of the rear face. Ideally, a width of the recess of the solid cover is equal to that of the tongue of the sliding bar. FIGS. 7 & 8 show a conduit 40 formed in the periphery of the solid cover and extending through and in perpendicular relationship with the rectangular recess. The rear face of the solid cover may be removably positioned between the side walls of the base such that the tongue of the sliding bar resides within the recess in the first orientation. The recess of the solid cover ensures that the bore of the sliding bar remains in alignment with the conduit of the solid cover.

Finally, a locking plunger 42 is slidably positioned within the conduit of the solid cover. As shown in the Figures, the locking plunger has an outboard end with a key hole formed therein. In use, the locking plunger has a first orientation with an inboard end out of engagement with the tongue of the sliding bar and the outboard end extending from solid cover through the cutouts of the base. In a second orientation, the inboard end of the locking plunger is inserted within the bore of the tongue of the sliding bar for maintaining the same within the first orientation to preclude opening of the door.

It should be noted that the operation of the locking plunger may be accomplish in several ways. Ideally, the locking plunger is spring loaded such that the same is unbiased in the first orientation and biased in the second orientation. When the locking plunger is transferred to the first orientation it is preferably automatically locked until the insertion and rotation of a key within the outboard end. In the alternative, a radially extending retractable tab may be mounted on the plunger to engage a recess formed in the conduit in the first orientation. Of course, still other methods may be employed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A door locking assembly comprising, in combination:

a base including a pair of halves each including a semicircular rear plate with a front face, a rear face and a periphery formed therebetween defined by a linear edge and a semicircular edge, a first one of the halves for being mounted to a door and a second one of the halves for being mounted on a door frame such that the linear edges of the halves reside continuous with an edge of the door and the frame, respectively, each half of the base having a pair of vertically spaced countersunk bores formed in the front face thereof, a dovetail recess formed between the linear edge and a central extent of the rear plate, and a peripheral side wall integrally coupled to the semicircular edge and extending therefrom in perpendicular relationship therewith, the peripheral side wall of each half having a slot formed therein which extends along a central 30 degree arc of the peripheral side wall in parallel with the rear plate and an outer edge of the peripheral side wall, the peripheral side wall of each half further including a cut out formed in the outer edge of the peripheral side wall at a lower end thereof;

a sliding bar having a generally planar rectangular configuration including a front face, a rear face and a periphery formed therebetween with a linear top edge, a linear bottom edge and a pair of tapering side edges, the front face of the sliding bar having a disk-shaped tongue integrally coupled to a central extent thereof with a bore formed therein which is formed about an axis parallel with a plane in which the sliding bar resides and further bisects the sliding bar, the rear face of the sliding bar having a dovetail tenon formed in a central extent thereof with a width about ⅓ that of the tongue, wherein the dovetail tenon is slidably received within the dovetail recesses of the rear plate such that the sliding bar has a first orientation with the side edges thereof in engagement with both slots of the base for precluding the door from being opened and a second orientation and a third orientation each with only one of the slots of the base receiving the sliding bar for allowing the door to be opened;

a solid cover including a planar circular front face, a rear face with a planar semicircular lower extent and an inset planar semicircular upper extent, and a periphery formed therebetween, the solid cover having a rectangular recess formed in the upper extent of the rear face with a width equal to that of the tongue of the sliding bar and a conduit formed in the periphery of the solid cover and extending through and in perpendicular relationship with the rectangular recess, wherein the rear face of the solid cover may be removably positioned between the side walls of the base such that the tongue of the sliding bar resides within the recess in the first orientation and the bore of the sliding bar remains in alignment with the conduit of the solid cover; and a locking plunger slidably positioned within the conduit of the solid cover and having an outboard end with a key hole formed therein, the locking plunger having a first orientation with an inboard end out of engagement with the tongue of the sliding bar and the outboard end extending from the solid cover through the cutouts of the base and a second orientation with the inboard end inserted within the bore of the tongue of the sliding bar for maintaining the same within the first orientation to preclude opening of the door.

2. A door locking assembly comprising:

a base including a pair of halves, a first one of the halves for being mounted to a door and a second one of the halves for being mounted on a door frame, the halves each having a slot formed therein;

a sliding bar having a first orientation in engagement with both slots of the base for precluding the door from being opened and a second orientation with only one of the slots of the base receiving the sliding bar for allowing the door to be opened;

a cover removably mounted over the sliding bar for precluding the same from being removed from the first orientation thereof; and a locking mechanism for precluding the removal of the cover.

3. A door locking assembly as set forth in claim 2 wherein the base has a peripheral side wall for receiving the cover therebetween.

4. A door locking assembly as set forth in claim 2 wherein the sliding bar has a bore formed therein which is in alignment with a conduit of the cover through which a plunger of the locking mechanism extends.

5. A door locking assembly as set forth in claim 4 wherein the bore of the sliding bar is formed in a tongue of the sliding bar which is removably received within a recess formed in the cover.

6. A door locking assembly as set forth in claim 2 wherein the sliding bar is slidably engaged with the base via a recess and tenon combination.

* * * * *